United States Patent [19]

Fischer et al.

[11] Patent Number: 4,828,007

[45] Date of Patent: May 9, 1989

[54] PROCESS FOR SELECTIVELY COMPRESSING GRANULAR MATERIAL IN A MOLDING BOX

[75] Inventors: Kurt Fischer; Hans Leutwiler, both of Schaffhausen, Switzerland

[73] Assignee: Georg Fischer AG, Schaffhausen, Switzerland

[21] Appl. No.: 279,505

[22] Filed: Dec. 5, 1988

Related U.S. Application Data

[63] Continuation-in-part of Ser. No. 173,651, Dec. 16, 1987, abandoned.

[51] Int. Cl.[4] ..... B22C 15/00

[52] U.S. Cl. ..... 164/37; 164/169

[58] Field of Search ..... 164/37, 169

[56] References Cited

U.S. PATENT DOCUMENTS

| | | | |
|---|---|---|---|
| 4,415,015 | 11/1983 | Zadera | 164/37 |
| 4,546,810 | 10/1985 | Landolt | 164/37 |
| 4,598,756 | 7/1986 | Fuchigami et al. | 164/37 |
| 4,609,033 | 9/1986 | Kobel et al. | 164/169 |
| 4,617,978 | 10/1986 | Damm | 164/37 |

FOREIGN PATENT DOCUMENTS

| | | | |
|---|---|---|---|
| 3238712 | 4/1984 | Fed. Rep. of Germany | 164/169 |
| 55-141355 | 11/1980 | Japan | 164/37 |
| 55-144359 | 11/1980 | Japan | 164/37 |
| 471151 | 9/1975 | U.S.S.R. | 164/169 |
| 1207622 | 1/1986 | U.S.S.R. | 164/169 |

*Primary Examiner*—Nicholas P. Godici
*Assistant Examiner*—J. Reed Batten, Jr.
*Attorney, Agent, or Firm*—Bachman & LaPointe

[57] ABSTRACT

Granular material is selectively compressed in a molding box by a series of pressure surges applied over the granular material.

16 Claims, 1 Drawing Sheet

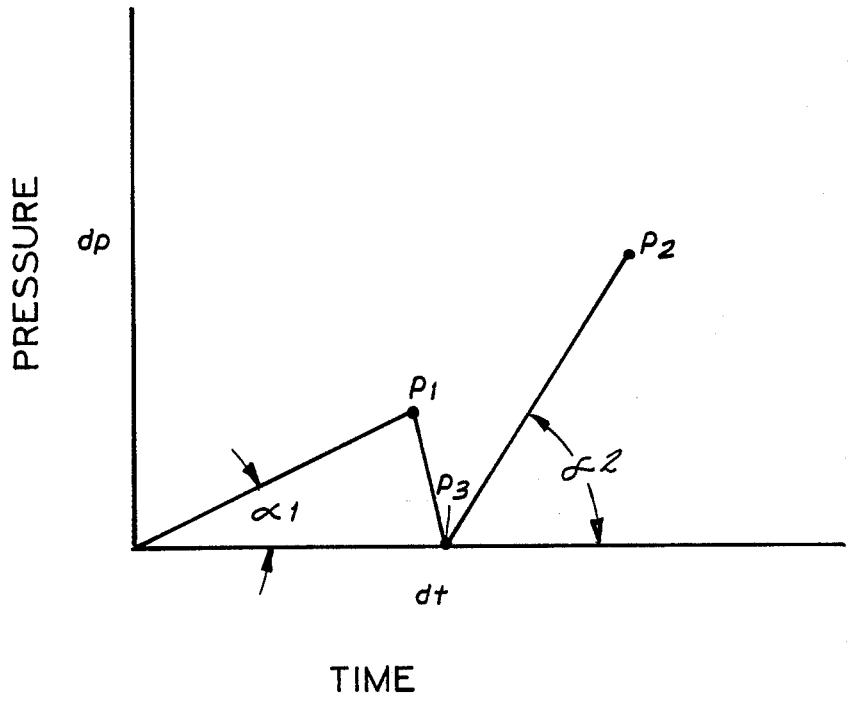
PRESSURE
dp
P2
P1
P3
α1
α2
dt
TIME

PROCESS FOR SELECTIVELY COMPRESSING GRANULAR MATERIAL IN A MOLDING BOX

CROSS REFERENCE TO RELATED APPLICATION

This application is a continuation-in-part of U.S. application Ser. No. 173,651, filed Dec. 16, 1987 and now abandoned.

BACKGROUND OF THE INVENTION

The present invention relates to a process for selectively compressing granular material in a molding box and, more particularly, a process wherein the granular material is compressed by a series of pressure surges applied over the granular material.

The packing of granular molding materials for the purposes of producing factory molds is old and well known in the prior art. It is customary when packing the granular molding materials to provide a predetermined amount of a compressed medium over the molding box which acts upon the granular material in the molding box to compress same. A typical arrangement is disclosed in German Patent Specification No. 19 61 234 which discloses a typical process for packing granular molding material wherein the packing of the molding material is effected by the expansion of a high pressure gas within the molding apparatus. During the packing process the gas, which is stored under pressure in a reservoir, is transferred within a very short time interval to the surface of the granular material so as to impact on the surface of the material being compressed. The pressure is maintained on the surface of the granular material for a predetermined time interval and thereafter the pressure is reduced by means of venting.

Processes of the foregoing type result in a casting mold hardness profile which decreases from the pattern to the back of the mold as a consequence of the compression characteristics. While this hardness profile provides ideal conditions for degasification of the casting molds, there are a number of disadvantages which result from such a process. These disadvantages include (a) irregularity of the hardness of the mold; (b) noise resulting from the one time, sudden compression surge; and (c) compression defects due to the high sand flow velocity.

Naturally, it would be highly desirable to provide a process which allows for the selective compression of the granular material in a casting mold which would eliminate the disadvantages noted above with regard to processes heretofore known.

Accordingly, it is a principal object of the present invention to provide a process for compressing granular materials in a molding box.

It is a particular object of the present invention to provide a process for compressing granular material wherein the material is compressed by sequential pressure surges.

It is a further object of the present invention to provide a process as set forth above wherein the mold hardness profile of the compressed mold decreases from the pattern to the back of the mold.

Further objects and advantages of the present invention will appear hereinbelow.

SUMMARY OF THE INVENTION

In accordance with the present invention the foregoing objects and advantages are readily obtained.

The present invention relates to a process for compressing granular material in a molding box. The mold apparatus employed in the process of the present invention comprises a pattern plate, a casting pattern on the pattern plate and a mold frame mounted on the pattern plate so as to define therewith a mold cavity around the casting pattern. In accordance with the particular features of the process of the present invention, a granular material is fed to the mold cavity such that the granular material surrounds and covers the casting pattern thereby forming a surface layer of granular material. A first pressure surge D1 of compressed medium such as air or the like is applied to the surface layer of the granular material so as to produce a first pressure p1 over the granular material wherein the granular material fills irregularities in the casting pattern. After maintaining a pressure for a predetermined time interval the pressure over the material is reduced to a lever p3. Thereafter a second pressure surge D2 of compressed medium is applied to the surface layer of the granular material so as to produce a second pressure p2 over the material for compressing same. Finally, the compressed cast can be removed from the device by reducing the pressure over the material to atmospheric pressure. The foregoing process results in a mold hardness profile of the compressed mold which decreases from the pattern to the back of the mold.

In accordance with a particular feature of the present invention the first pressure surge D1 has a pressure gradient (rate of pressure change over time) of $\alpha$ 1 (dp/dt) and the second pressure surge has a pressure increase of $\alpha$ 2 (dp/dt) where $\alpha$ is the angle of the pressure gradient. Thus, the pressure gradient or rate of pressure change over time of the second pressure surge D2 is greater than the first pressure surge D1 and substantially twice the rate of the first pressure surge D1.

BRIEF DESCRIPTION OF THE DRAWINGS

The FIGURE is a graph illustrating the process of the present invention.

DETAILED DESCRIPTION

It is known that in the process for compressing granular material in a molding box that the pressure gradient is decisive for producing a well compressed mold rather than the pressure over the material, that is the pressure increase per unit of time over the granular material. The pressure surge is generated from a compressed medium source which is applied to the surface of the mass of the granular material at a very high velocity thereby accelerating the flow of the granular material. The steeper the pressure gradient, that is the larger the angle $\alpha$ is, the greater is the acceleration of the granular material mass.

The degree of compression in the pattern area is initially a function of the configuration of the pattern plate. Thus, the narrower the intervals between individual pattern area or between the pattern and the enclosing wall frame, the more problematic is the compression of the granular material in these areas. The difficulty actually begins when the granular material is first poured into the molding box. Mold areas with deep pockets or narrow mold clearances cannot always be optimally supplied with the granular material during the filling procedure. The subsequent sudden compression surge used in known processes with a steep pressure increase can therefore lead to irregular hardness values and to defective portions in the compressed mold.

It has been found however in accordance with the process of the present invention that a two stage gas pressure surge wherein the surge is applied in a sequential manner lead to improved mold quality which is reliably reproducible on production levels with very good quality. In accordance with the process of the present invention and with reference to the FIGURE, the first pressure surge, D1, has a relatively gradual pressure increase gradient, $\alpha$ 1 (dp/dt), in order to achieve a first predetermined desired pressure p1. The volume of air introduced with the pressure surge permeates the volume of the granular sand and it escapes, at least partially, by means of an air removal system located in the pattern plate, see for example German Patent Specification No. 19 61 234. As a result of this first pressure surge, D1, the granular material is moved sufficiently about the pattern in order to compensate for any possible irregularities in the pattern area which may have occurred during the feeding of the granular material to the mold cavity. This first pressure surge also achieves sufficient filling density and packing density in the pattern area. After the pressure is reduced over the granular material to a level p3, a second pressure surge, D2, is applied over the granular material wherein the second pressure surge D2, $\alpha$ 2 (dp/dt), has a considerable steeper pressure gradient than the first pressure surge, D1 and preferably twice the first pressure surge. As noted above this pressure gradient is characterized by the angle $\alpha$ 2. The pressure surge D2 is applied to achieve a second predetermined pressure p2 over the granular material so as to compress same. The pressures p1 and p2, achieved by the pressure surges D1 and D2 as set forth above, are within a range of 20 bar maximum, that is, the difference between the two pressures is less than or equal to 20 bar. The pressure p3, which is achieved between the two pressure surges D1 and D2, must be less than the pressures p1 and p2 and results primarily from the reduction in pressure which occurs after the first pressure surge D1.

It is clear from the foregoing that the expression dp/dt represents a pressure gradient in terms of incremental pressure change per unit time and in the present invention is expressed as bars per second. In accordance with the present invention the gradient $\alpha$ 1 should not exceed 300 bars per second and preferably is not greater than 40 bars per second.

The process of the present invention as set forth above leads to qualitative advantages in the compression of the granular material in a molding box. By the process of the present invention the hardness can be controlled better for the entire sand volume thereby leading to uniform material hardness both for shallow and deep molds. The mold back remains relatively soft, that is, the process provides the gas permeability which is needed for the casting process. This is a significant advantage over known procedures which employ mechanical post compression. In accordance with the present invention it should be appreciated that it would be possible to use more than two successive pressure surges to accomplish the results of the present invention. An apparatus usable to perform the process of the present invention would include a single pressure chamber having a single nozzle or plurality of nozzles or a plurality of pressure chambers connected to the molding box for providing the pressure surges over the granular material to be compressed.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A process for compressing granular material in a molding box having a pattern plate, a casting pattern on said pattern plate and a mold frame mounted on said pattern plate so as to define therewith a mold cavity around said casting pattern comprising the steps of:

(a) feeding said granular material to said mold cavity such that said granular material surrounds and covers said casting pattern thereby forming a surface layer of said granular material;

(b) applying a first pressure surge D1 of compressed medium to said surface layer of said granular material at a first rate of pressure change over time so as to produce a first pressure p1 over said material wherein said granular material fills any irregularities in the casting pattern;

(c) reducing the pressure over said material to a level p3;

(d) thereafter applying a second pressure surge D2 of compressed medium to said surface layer of said granular material at a second rate of pressure change over time so as to produce a second pressure p2 over said material wherein said granular material is compressed wherein said second rate of pressure change over time is greater than said first rate of pressure change over time; and (e) reducing the pressure over said material to atmospheric pressure.

2. A process according to claim 1 wherein said first pressure surge D1 has a pressure increase gradient of $\alpha$ 1 (dp/dt) and said second pressure surge D2 has a pressure increase gradient of $\alpha$ 2 (dp/dt) where $\alpha$ is the angle of the pressure gradient.

3. A process according to claim 2 wherein $\alpha$ 1 (dp/dt)$\leqq$300 bars/second.

4. A process according to claim 2 wherein $\alpha$ 1 (dp/dt)$\leqq$40 bars/second.

5. A process according to claim 1 wherein p1>p3, p2>p3 and the difference between p1 and p2 is less than or equal to 20 bar.

6. A process according to claim 1 wherein said first pressure surge D1 and said second pressure surge D2 are generated from a common pressure chamber.

7. A process according to claim 1 wherein said first pressure surge D1 and said second pressure surge D2 are generated from different pressure chambers.

8. A process according to claim 6 wherein said common pressure chamber is provided with a first nozzle and a second nozzle for generating said first and second pressure surges.

9. A process according to claim 6 wherein said common pressure chamber is provided with a single nozzle for generating said first and second pressure surges.

10. A process according to claim 1 wherein said second rate of pressure change over time is twice said first rate of pressure change over time.

11. A process according to claim 1 wherein α 1 (dp/dt)≦300 bars/second.

12. A process according to claim 1 wherein α 1 (dp/dt)≦40 bars/second.

13. A process according to claim 2 wherein p1>p3, p2>p3 and the difference between p1 and p2 is less than or equal to 20 bar.

14. A process according to claim 10 wherein α 1 (dp/dt)≦300 bars/second.

15. A process according to claim 10 wherein α 1 (dp/dt)≦40 bars/second.

16. A process according to claim 10 wherein p1>p3, p2>p3 and the difference between p1 and p2 is less than or equal to 20 bar.

* * * * *